United States Patent [19]

Stull

[11] Patent Number: 4,653,676

[45] Date of Patent: Mar. 31, 1987

[54] CAPTIVE CAP CONSTRUCTION FOR HAND-HELD DISPENSER

[76] Inventor: Gene Stull, 5 Oak St., Chester, N.J. 07930

[21] Appl. No.: 687,034

[22] Filed: Dec. 28, 1984

[51] Int. Cl.[4] ..... B65D 25/40

[52] U.S. Cl. ..... 222/566; 222/212; 222/543; 29/453; 53/367; 215/321; 285/921; 239/600

[58] Field of Search ..... 222/153, 566, 212, 543, 222/570; 220/353; 215/321; 53/367; 239/327, 600; 285/DIG. 22, 24; 29/453

[56] References Cited

U.S. PATENT DOCUMENTS

| | | | |
|---|---|---|---|
| D. 267,701 | 1/1983 | Pardo et al. | D9/375 X |
| 3,019,933 | 2/1962 | Gould et al. | 215/321 |
| 3,209,963 | 10/1965 | Krieps et al. | 222/543 |
| 3,231,156 | 1/1966 | Schultz | 285/DIG. 22 X |
| 3,341,083 | 9/1967 | Stewart | 239/327 X |
| 3,388,842 | 6/1968 | Costa | 222/566 |
| 3,604,585 | 9/1971 | Towns | 222/153 X |
| 3,884,394 | 5/1975 | Hazard | 222/153 |
| 3,927,805 | 12/1975 | Stull | 222/153 |
| 4,281,778 | 8/1981 | Stull | 222/153 |
| 4,454,965 | 6/1984 | Kirk | 222/153 |

FOREIGN PATENT DOCUMENTS

| | | | |
|---|---|---|---|
| 228188 | 11/1958 | Australia | 222/570 |

*Primary Examiner*—Joseph J. Rolla
*Assistant Examiner*—Frederick R. Handren
*Attorney, Agent, or Firm*—H. Gibner Lehmann; K. Gibner Lehmann

[57] ABSTRACT

A hand-held dispenser including a container having a dispensing neck portion provided with an exterior, annular locking-type retention bead and a nozzled dispenser cap adapted to be forcibly applied to the neck portion and to be permanently retained thereon. The container neck portion has a circumferentially facing abutment shoulder disposed above its bead, and the cap has an internal locking-type retention bead cooperable with the bead on the neck portion. The cap also has a locater lug which can engage the abutment shoulder of the neck portion during initial relative turning application of the cap, thereby to halt the latter in a predetermined rotative position. A recess on the neck portion receives the locater lug as the cap, subsequent to its halting, is axially applied. The arrangement is such that the cap will always be positioned on the neck portion at a fixed, rotative position. This construction is of value with dispensers intended to discharge liquid in the form of a lateral stream, as well as with dispensers of the type which are non-cylindrical or otherwise assymetric about a central axial line.

1 Claim, 8 Drawing Figures

CAPTIVE CAP CONSTRUCTION FOR HAND-HELD DISPENSER

BACKGROUND

This invention relates generally to hand-held dispensers, and more particularly to dispensers of the type wherein a separate nozzled cap is permanently assembled to a container following filling of the latter with the intended product.

Over the years there have been proposed and produced a number of dispensers involving closure constructions employing threaded overcaps which were adapted to be screwed onto the threaded necks of containers. Several such dispensers are illustrated in U.S. Pat. Nos. 3,406,880; 3,216,630; 3,598,285; and 3,276,640.

A somewhat different arrangement involving an overcap which was intended to be snapped into position and permanently retained in the neck of a container is illustrated in U.S. Pat. No. 3,113,693. In this latter instance, the container was constituted of metal, and had a thin top wall containing an aperture with a curled-over edge that provided a bead-like structure and at the same time stiffened the wall, such that a depending skirt on the plastic overcap or cap part could be forced into the aperture and permanently retained therein.

In all of these constructions the ultimate angular position of the overcap with respect to the container was of no special consequence, since the product was dispensed from the opening in the overcap, and in most cases, this opening was located substantially at the axis of the container. Moreover, most containers were symmetrical about an axial line or a median plane, and accordingly the screw-type securement that was provided proved generally satisfactory in almost all respects. Similarly, in the case of the snap-type installation illustrated in U.S. Pat. No. 3,113,693, the particular orientation of the cap with respect to the container body was of no special significance as far as the intended operation or function of the device was concerned.

Some of the more recent container designs have involved assymetric shapes; others have employed overcap constructions that had specially formed apertures or nozzles which were intended to discharge liquid product in a lateral or skewed direction, that is, at an angle with respect to the axis of the container. For example, recently developed squeeze-bottle dispensers for bathroom bowl cleaning solutions have incorporated spout constructions wherein the consumer could invert the container and direct a stream slightly upwardly so as to reach underneath the lip of the bowl. Still, some of these dispensers presented difficulties for the consumer in that proper manipulation of the dispenser and directing of the stream to the desired areas was awkward. Also, as the container neared an empty condition, air from the interior tended to mix with the liquid if the container was not inverted sufficiently.

Some of the overcaps currently in use are assymetric; that is, they incorporate hinged closure or stopper plugs for sealing off the opening in the overcap. Others involve structural safety features for preventing inadvertent opening of the dispenser by an infant or child, for example.

Most prior dispenser constructions did not make provision for establishing any type of registration between an overcap and the container therefor; accordingly, where apertured screw caps employing screw threads that mated with cooperable threads on the exterior of a container neck were employed, the ultimate angular position of the cap was for the most part indeterminate. It depended upon the nature of the threads on the cap and container neck, as well as the torque applied thereto during assembly. Substantial deviations occurred with the application of different torques, regardless of whether manual or automatic assembly (capping) equipment was used. In addition, where no provision was made for retaining an overcap in a particular position following such assembly, shifting would frequently occur during handling of the dispenser. Often the dispensing container and cap were wiped off or otherwise cleaned following filling, and this operation sometimes caused an undesirable relative turning to occur between the two parts.

SUMMARY

The above disadvantages and drawbacks of prior dispenser constructions are largely obviated by the present invention, which has for an object the provision of a novel and improved hand-held dispenser which is extremely simple in its construction, while at the same time permitting the establishment of a positive predetermined angular orientation of the overcap with respect to the container carrying it.

A related object of the invention is to provide an improved hand-held dispenser as above described, wherein a cap having a dispensing orifice of a type that generates an angled or laterally directed stream can be accurately assembled to the container in such a manner as to always occupy a given, desired relative angular position thereon.

A related object of the invention is to provide an improved hand-held dispenser as above set forth, wherein the cap can be assembled to the container with a predetermined angular disposition, and with the use of automatic capping equipment, so as to reduce overall assembly costs.

Still another object of the invention is to provide an improved hand-held dispenser of the kind indicated, wherein the cap part can be molded as a single integral piece, and wherein the molded piece can be merely snapped into position on the container following orientation, and thereafter be permanently retained against both rotation and removal.

Yet another object of the invention is to provide an improved hand-held dispenser as above characterized, wherein the container is assymetric, and wherein a directional discharge characteristic of the cap is employed in conjunction with the assymetrical configuration of the container, in order to facilitate the use of the dispenser by the consumer.

A still further object of the invention is to provide an improved hand-held dispenser as outlined above, wherein the cap incorporates a child-resistant feature, so as to minimize the possibility of inadvertent ingestion of potentially toxic contents by an infant or small child.

The above objects are accomplished by a hand-held dispenser including a container having a dispensing neck portion provided with exterior retention means, and a dispenser cap adapted to be applied to the neck portion and to be press-fitted thereover. The neck portion has an abutment shoulder facing laterally of its axis, and the cap has internal retention means cooperable with the retention means on the neck portion to enable the cap to be locked thereon. The cap also has a locater lug adapted to engage the abutment shoulder of the neck portion during initial relative turning application of the cap, thereby to halt the cap in a predetermined angular position on the neck portion. The latter has a recess adapted to receive the locater lug as the cap, subsequent to its halting, is forced downwardly, so as to lockingly engage the retention means of the cap and neck portions.

The above construction has a number of distinct advantages. It enables the cap to be assembled to the container always with a predetermined angular disposition. That is, a particular portion of either the cap or the container can be made to register with a corresponding portion of the other part. Such a relationship is of value where the spout of the cap has a configuration that is intended to provide a directional or lateral discharge with respect to the container, especially those containers which are of a type which are assymetric about a central axial line.

Where the cap is of the child-resistant variety, the directions for opening the cap can be placed on the container in such a location that the consumer will be viewing the cap from the desired angle. That is, if it is necessary to perform a particular operation on the stopper plug in order to open the dispenser, the directions for doing so can be placed at an area where the plug will be readily visible by the consumer, thereby facilitating the process.

In addition, with certain types of assymetric caps, it has been determined by marketing experts that the aesthetic appeal of the dispenser is significantly enhanced by positioning the caps of a series of side-by-side dispensers such that they all face in the same direction when displayed on the shelves of a store or warehouse. A more pleasing appearance thereby results.

Moreover, with the present construction, once the cap is assembled to the container, it will permanently resist all subsequent turning. Thus there is eliminated the possibility of the cap shifting with respect to the container body, as otherwise might occur during cleaning of the container following filling, handling, shipping, unloading, etc.

Still other features and advantages will hereinafter appear.

In the drawings, illustrating a preferred embodiment of the invention:

Figure 6:
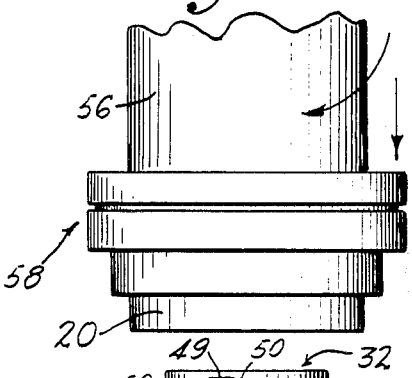
Figure 7:
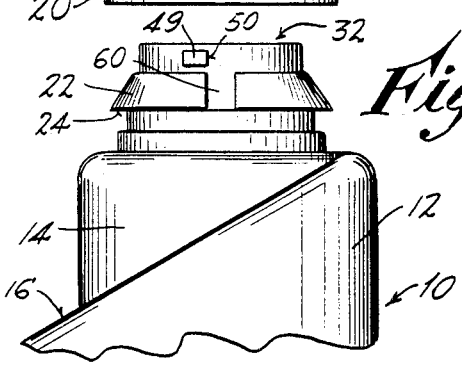

FIGS. 6 and 7 are side elevational views, respectively, of automatic capping equipment adapted to temporarily hold a cap in position over a container, and of the container neck area, the views particularly showing the novel method of assembling the cap to the container, wherein a predetermined angular orientation or disposition is established between the cap and container just prior to assembly of the cap onto the container neck.

Figure 8:
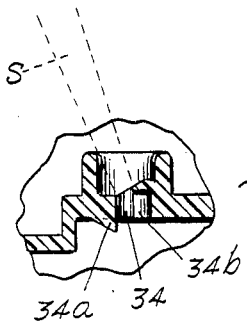

FIG. 8 is an enlarged fragmentary section through the cap, showing the configuration of the dispensing aperture or spout.

Figure 1:
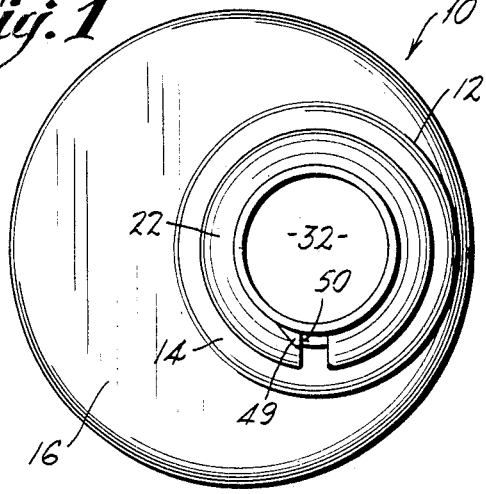
FIG. 1 is a top plan view of a container having a neck portion provided with retention means in the form of a retention bead, and a positioning lug or abutment shoulder adapted to cooperate with a corresponding abutment shoulder or locater lug on the inner surface of a cap.
Figure 3:
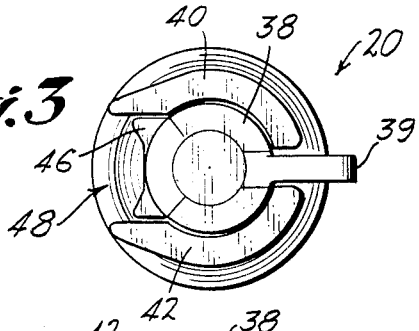
FIG. 3 is a top plan view of the cap associated with the container, showing a closure or stopper plug thereon disposed in a closed or sealing position.
Figure 4:
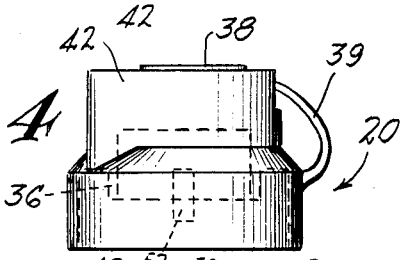
FIG. 4 is a side elevational view of the cap of FIG. 3.
Figure 2:
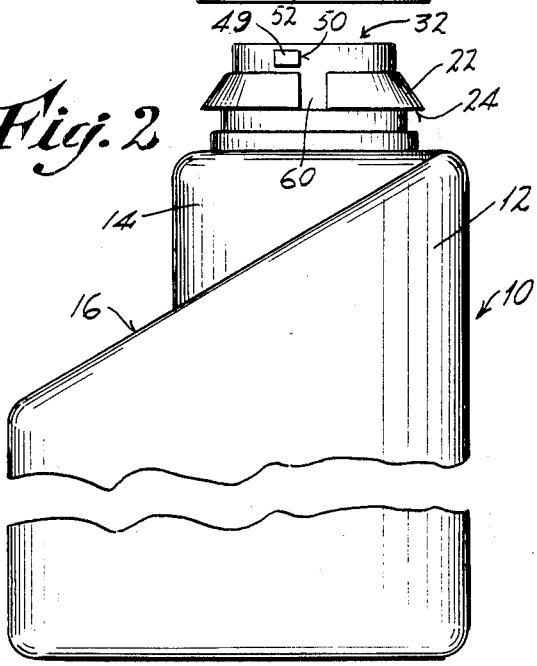
FIG. 2 is a fragmentary side elevational view of the container of FIG. 1.

Referring first to FIGS. 1 and 2 there is illustrated a dispensing container of the hand-held type, generally designated by the numeral 10, having a body portion 12 that is of cylindrical configuration, and a neck portion 14 which is integral with the body portion and which extends upwardly from a sloping top wall 16 of the container. The container 10 is intended to be permanently fitted with an apertured cap 20, shown particularly in FIGS. 3–5 and to be described below.

In accordance with the present invention there is provided a novel and improved retention and positioning means on both the container neck portion 14 and cap 20, by which the latter, when assembled onto the neck portion, is always disposed in one single predetermined angular position with respect thereto, and thereafter permanently and positively retained in the said predetermined position against inadvertent turning, whereby a determinate relationship is established and maintained between the container 10 and the cap 20.

In accomplishing the retention of the cap 20 on the container neck portion 14, the latter is provided with retention or retainer means which preferably but not necessarily takes the form of an annular retention bead 22 having an upper camming surface of generally conical configuration, and also having a sharp undercut that forms a retainer shoulder 24. Similarly, on the underside of the cap 20, there are cooperable retention means preferably in the form of a retention bead 26, shown in FIG. 5. The bead 26 is preferably continuous, but can take the form of a ring having wider segments or areas 28 that are connected by narrower areas or webs 30. Such an arrangement permits the wide areas 28 to yield by a limited amount in a radially outward direction, which facilitates their by-passing the relatively stiffer bead 22 when the cap 20 is forced axially downward on the container neck portion 14, as occurs during completion of the assembly.

The container neck portion 14 has a discharge opening or aperture 32. The cap 20 similarly has a discharge aperture 34 which is relatively small compared to the size of the container opening. Also, opposite walls **34*a* and 34*b* of the discharge aperture 34 are preferably so arranged with respect to the axis of the cap, that predetermined discharge characteristics can be imparted to a stream in order to suit a particular application, whereby the stream S is directed laterally, or at an angle with respect to the axes of the cap and container. The wall 34*a* is in the form of a downward projecting bump having a semi-conical configuration, and the wall 34*b* is the result of a recess alongside the aperture 34, all as clearly seen in FIG. 8. In the present instance, the aperture 34 is such that the stream would be directed toward the left in FIGS. 3–5**.

Figure 5:
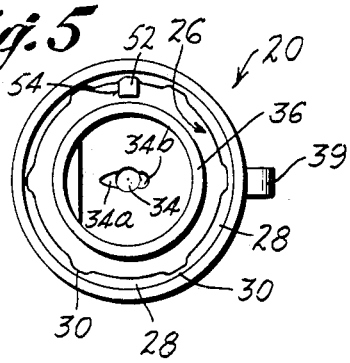
FIG. 5 is a bottom plan view of the cap of FIGS. 3 and 4.

In FIG. 5 the underside of the cap 20 has a depending skirt 36 that is received in the opening 32 of the container and forms a seal therewith. The cap also has a stopper plug 38, FIGS. 3 and 4, that is held captive on the cap by a flexible web 39. The stopper plug 38 is moveable between a sealing position as shown, wherein it overlies the opening 34 of the cap, and a discharge position (not shown), wherein the opening is exposed. Disposed on opposite sides of the stopper plug 38 are two upstanding arcuate shoulders or barriers 40, 42 having upper surfaces which are roughly at the same height as that of the plug 38 when the latter is closed, as in FIGS. 3 and 4. The barriers 40, 42 bar access to the sides of the plug, and thereby render the cap child-resistant. The front of the plug 38 has a finger-engageable lifting tab 46, and a clearance opening 48 between the barriers 40, 42 permits access to the lifting tab 46 by the fingernail of the consumer.

In accordance with the present invention there are provided on the neck portion 14 of the container 12, and on the cap 20, cooperable abutment structures which enable the cap to be permanently assembled to the container with a predetermined, desired angular disposition therebetween, such that once assembled, the cap is both permanently retained and thereafter held against subsequent rotative or turning movement. In accomplishing the above objective, there is provided on an uppermost exterior extension of the neck portion 14 a projecting lug constituting a positioning shoulder 49 presenting a relatively flat face 50 that preferably lies in a radial plane. In addition, on the underside of the cap 20 there is a cooperable locater, positioning and abutment lug 52 having a face or shoulder 54 also lying in a generally radial plane with respect to the cap 20. These lugs insure the correct initial and final positioning of the cap during assembly of the latter to the container, as now will be explained.

FIGS. 6 and 7 show a preferred method of assembling the cap 20 to the container 12, wherein automatic capping equipment comprising a turnable chuck 56 and slip-clutch 58 would be employed. In practice, the container 12 would be held stationary in a suitable fixture (not illustrated), and the cap 20 installed in the chuck 56 and temporarily held captive therein. The chuck 56 and cap 20 are then advanced in an axially downward direction in FIG. 6, as indicated by the vertical arrow. Also, the chuck is turnably driven clockwise as viewed from above in FIG. 6, by an amount sufficient to cause the locater lug 52 of the cap to engage the positioning lug 49 on the container neck portion 14. At this time, the slip-clutch 58 will be rendered operative, or slip, and the chuck 56 and cap 20 will further advance in the axially downward direction. The locater lug 52 of the cap can enter a recess 60 in the bead 22 at roughly the same time that the bead 26 of the cap by-passes the bead 22 and comes to rest under the shoulder 24 thereof. Following this, the chuck 56 will release the cap, and the latter will now be retained by and remain permanently captive on the neck portion 14 by virtue of the engagement of the beads 26 and 22.

Subsequent caps 20 would be assembled to their respective containers 12 in a similar manner, such that all of the caps would have respective portions in registration with corresponding parts of the respective containers. The engagement of the lug 52 with either of the opposite walls or shoulders of the recess 60 will at all times positively and permanently prevent relative turning of the cap 20 with respect to the neck portion 14 and container 12 after by-pass of the beads 22 and 26 has occured. The cap is thus restrained by such engagement.

The capability of establishing a fixed rotative spatial relationship between the cap and container is significant in a number of important respects.

First, in the case of the container 12 that has been disclosed herein, it can be seen that the neck portion 14 is axially offset with respect to the axis of the remainder of the container. This offset is clearly illustrated in FIGS. 1 and 2. The offset thus locates the discharge opening at one side of the container; in the present instance, the dispenser comprising the container and cap is intended for use with bowl cleaners. The manufacturer has determined that a bottle or container having the configuration shown enables the discharge stream to be more easily directed under the lip of the bowl than would be the case were a central discharge opening employed. In addition and as noted above, the spout or dispensing opening 34 of the cap has a directional characteristic wherein the stream emanates laterally, in a direction toward the left in FIG. 2; that is, the stream is directed more or less perpendicular to the surface 16. Thus, when the container is inverted and squeezed in order to effect discharge of the contents, the cap can be positioned close to the underside of the lip of the bowl, and the stream directed either horizontally, or even in a slightly upward direction in order to reach under the lip. Better cleaning is thus achievable; in addition, the dispenser is easier to use because as the contents become depleted, the remaining liquid tends to accumulate around the neck portion 14 when the container is inverted. More complete emptying is thus attained, without deterioration in the characteristic of the stream.

In addition to the above advantages, as noted above the cap 20 that has been disclosed is of a child-resistant variety. In order to open the stopper plug 38, it is necessary for the consumer to insert his nail beneath the lifting edge 46 of the plug, and pry it off. To a consumer who is not already familiar with such an operation, it will probably be necessary to read instructions printed on a label of the container. It has been found that such instructions are best placed in a position where they can be read at the same time that the user is viewing the tab 46 from the left in FIGS. 3 or 4, as opposed to viewing the cap 20 from the side or rear, as for example, adjacent the location of the web 39. Accordingly, less difficulty is normally encountered by the consumer in effecting initial opening of the dispenser.

Finally, it has been determined by marketing personnel, that with containers that are not symmetric, as is the case in the particular device that has been disclosed, the appearance of a series of dispensers that have been stacked side-by-side on a shelf in a store is enhanced when the caps all face in the same direction, as opposed to a situation where the caps face randomly. While this consideration may not seem to be of great significance, it is believed that the aesthetic value of attractive packaging must be taken into account in successful marketing or promotions, since it is well established that consumer's tastes vary, and their purchases are in a large part governed by the physical appearance of an article. This fact can be easily demonstrated if one considers the processes employed to impart coloring to fruit. For instance, oranges which are initially pale are frequently colored with a rich orange artificial color, in order to enhance their appearance. It has been well established that a consumer will generally purchase a fruit having a more vivid color, as opposed to one which is pale, even though he or she might be aware that the item has been artificially colored.

Also, the present construction has the advantage of elimination of screw threads on the neck portion of a container, as well as cooperable screw threads on the inner surface of a cap. Accordingly there are completely eliminated all of the problems attendant the use of such threads, such as those involving proper starting of the threads, stripping thereof, misalignment, closer tolerances, etc.

The simple snap-on application of the cap of the present invention is thus seen to represent a cost effective solution to the problem of applying a cap construction to a container and wherein the cap is intended to occupy a predetermined, desired angular relationship with respect thereto.

Each and every one of the appended claims defines an aspect of the invention which is separate and distinct from all others, and accordingly each claim is intended to be treated in this manner when examined in the light of the prior art devices in any determination of novelty or validity.

Variations and modifications are possible without departing from the spirit of the claims.

What is claimed is:

1. A hand-held dispenser comprising, in combination:

(a) a container having a dispensing neck portion provided with an exterior, annular retention bead, (b) said neck portion having an uppermost exterior annular extension provided with a single external, radially outwardly projecting intercepting abutment shoulder facing laterally of its axis, (c) said abutment shoulder being separate from and spaced axially above the retention bead, and having an abutment face, (d) a dispenser cap having a side wall of generally cylindrical configuration, adapted to be applied to said neck portion to be press-fitted thereover, (e) said cap having an internal retention bead cooperable with the retention bead on the neck portion to lock the cap thereon, and having a single locater lug provided with a cooperable abutment face adapted to travel freely along said extension and engage the abutment face of the abutment shoulder of the neck portion during initial relative turning application of the cap with respect to the neck portion and prior to any engagement of said retention beads, thereby to halt the cap in solely one predetermined rotative position on the neck portion, (f) said locater lug on the cap comprising a projecting tooth which extends radially inwardly from the inner surface of the side wall of the cap and which is integral therewith, (g) said retention bead of the container neck portion having an axially extending recess adapted to receive said locater lug as the cap, subsequent to halting of its turning, is forced onto the neck portion to lockingly engage said retention beads, (h) said recess having oppositely-disposed walls, one of said walls being substantially in axial alignment with the abutment face of the abutment shoulder of the neck portion, such that the cap can be shifted essentially in solely an axial direction to a position wherein the locater lug occupies the recess in the retention bead of the neck portion and wherein the retention beads of the cap and neck portion have by-passed one another.

* * * * *